United States Patent [19]

Pinkstaff

[11] 4,284,869

[45] Aug. 18, 1981

[54] MICROWAVE WATER HEATER

[76] Inventor: Leo W. Pinkstaff, 1707 Talley St., Savannah, Tenn. 38372

[21] Appl. No.: 127,863

[22] Filed: Mar. 6, 1980

[51] Int. Cl.[3] ..... H05B 6/80

[52] U.S. Cl. ..... 219/10.55 A; 219/10.55 R; 219/305

[58] Field of Search ..... 219/10.55 R, 10.55 A, 219/10.55 F, 10.51, 10.65, 299, 302, 303, 304, 305, 378; 122/4 A, 13 A, 235 K; 165/139, 164; 126/344, 392

[56] References Cited

U.S. PATENT DOCUMENTS

| | | | |
|---|---|---|---|
| 1,418,011 | 5/1922 | Mehn | 219/39 |
| 2,585,970 | 2/1952 | Shaw | 219/10.55 A |
| 2,978,562 | 4/1961 | Fox | 219/10.55 A |
| 3,812,315 | 5/1974 | Martin | 219/10.55 A |
| 3,816,689 | 6/1974 | Long | 219/10.55 A |
| 3,920,945 | 11/1975 | Smith et al. | 219/10.55 R |
| 4,029,927 | 6/1977 | MacMillan | 219/10.55 R |
| 4,114,011 | 9/1978 | Stubbs | 219/10.55 A |
| 4,165,455 | 8/1979 | Mamfield | 219/10.55 A |

*Primary Examiner*—Arthur T. Grimley
*Attorney, Agent, or Firm*—Harvey B. Jacobson

[57] ABSTRACT

The water heater comprises three vertically spaced sections, each of which is controlled by a separate thermostat. Water to be heated is inputted at the lowest section and travels through a circuitous path both horizontally and vertically through that section. The thermostat is set at a low value and controls microwave tubes disposed in that section for providing initial heating of the water. The water circulates to a second section which is controlled by thermostat set at a higher temperature. Structure of the second stage is identical to that of the first and causes circuitous flow of water both horizontally and vertically through that section in order to provide intimate contact of the water with microwaves emitted by second microwave tubes. A third section is also constructed in a similar manner and includes a thermostat which is set at the final desired water temperature.

7 Claims, 7 Drawing Figures

Fig. 3
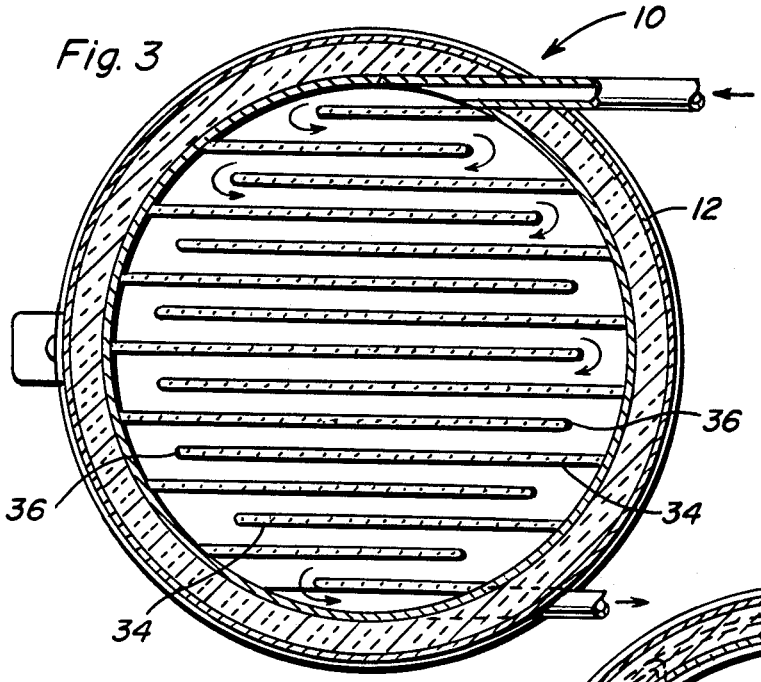
Fig. 6
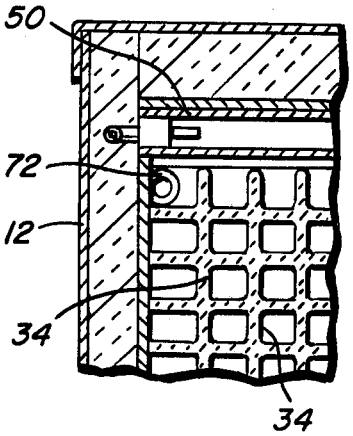
Fig. 4
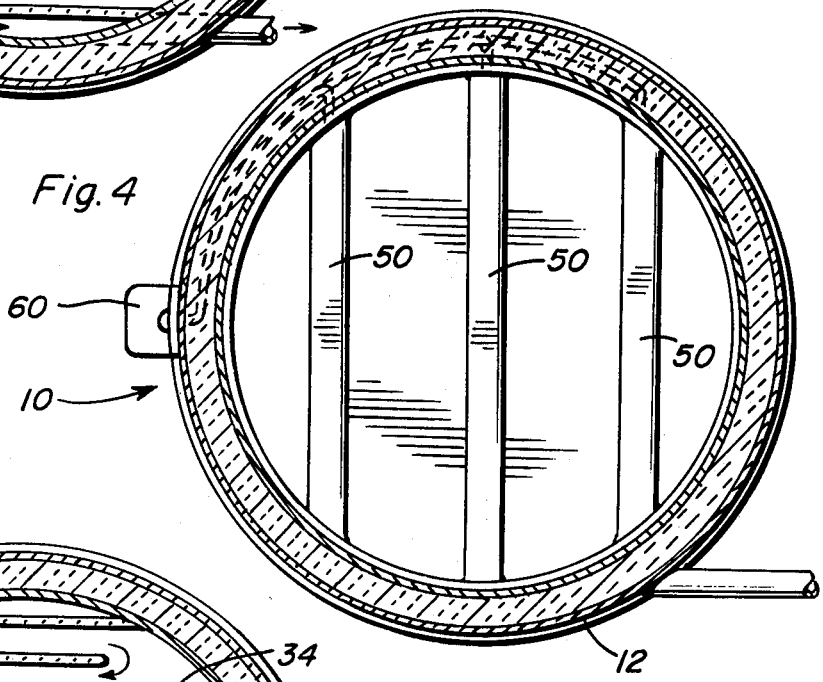
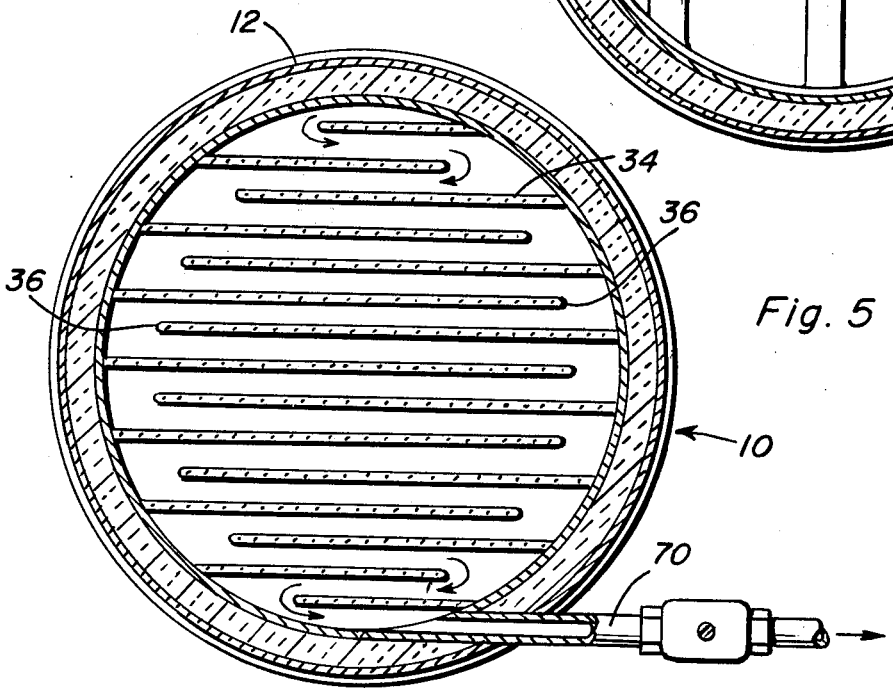
Fig. 5

MICROWAVE WATER HEATER

BACKGROUND OF THE INVENTION

1. Field of the Invention

This invention relates to water heaters and especially to such heaters which are adapted to provide rapid and efficient heating of water by use of microwaves.

2. Discussion of Related Art

Various microwave water heaters have been suggested. For instance, U.S. Pat. No. 2,978,562, issued Apr. 4, 1961 to Fox, shows a water heating system comprising an enclosure having a length of plastic tubing coiled within the enclosure. A magnetron tube is axially disposed within the coiled tubing. U.S. Pat. No. 3,812,315, issued May 21, 1974 to Martin, shows a microwave heater having a coiled tubular reservoir which is heated in different areas by a plurality of sequentially arranged pairs of dielectric plates. Microwave energy is supplied to the respective pairs of dielectric plates selectively by means of electrical switching mechanisms and thermostatic controls. U.S. Pat. No. 3,816,689, issued June 11, 1974 to Long, shows an apparatus for producing superheated fluids comprising a coiled tube having a high thermal conductivity embedded within an absorbtive maxtrix. The matrix is heated by microwave energy and the fluid to be vaporized or superheated passes through the coil. U.S. Pat. No. 4,029,927, issued June 14, 1977 to MacMillan, shows a microwave water heater having a water storage tank with a plate element disposed therein. The plate element has apertures formed therein and disposed substantially uniformly in the plate so as to define fluid communication therethrough between opposite sides of the plate. The plate element is disposed in transverse relation to water flowing through the tank so as to distribute water evenly throughout the tank.

SUMMARY OF THE INVENTION

One object of the present invention is to provide a water heater which rapidly and effectively heats water passing therethrough by the use of microwave energy.

A further object of the present invention is to provide a water heater wherein a plurality of heating zones are vertically spaced in order to provide incremental sequential heating of water passing through the zones.

An even still further object of the present invention is to provide a microwave water heater having a plurality of heating zones wherein water enters the bottom of the heater and progresses through the zones to an exit located at the top of the heater in order that the natural tendency for heat to rise aids in the efficiency of the water heater.

A yet still further object of the present invention is to provide a microwave water heater wherein each of the sections of the heater is provided with a plurality of horizontal and vertical partitions in order to produce a circuitous route in both horizontal and vertical planes in order to provide more intimate contact with the microwave energy passing through that section.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a top plan sectional view taken substantially along a plane passing through section line 3—3 of FIG. 2.

FIG. 4 is a bottom plan sectional view taken substantially along a plane passing through section line 4—4 of FIG. 2.

FIG. 5 is a top plan sectional view taken substantially along a plane passing through section line 5—5 of FIG. 2.

FIG. 6 is an elevational sectional view taken substantially along a plane passing through section line 6—6 of FIG. 2.

DESCRIPTION OF THE PREFERRED EMBODIMENT

Figure 1:
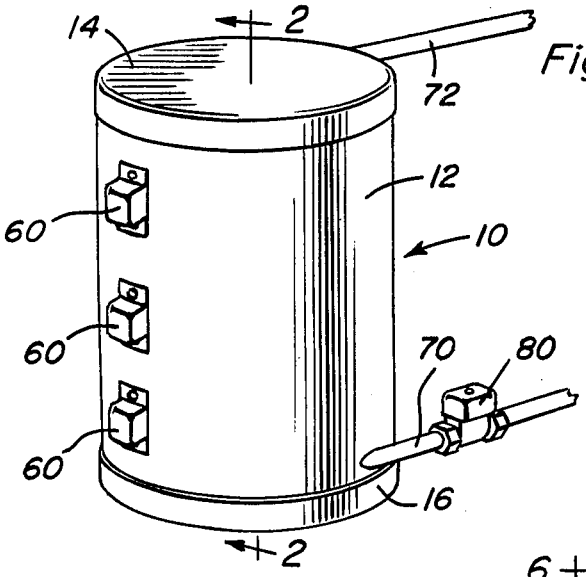
FIG. 1 is a perspective view of the water heater according to the present invention.
Figure 7:
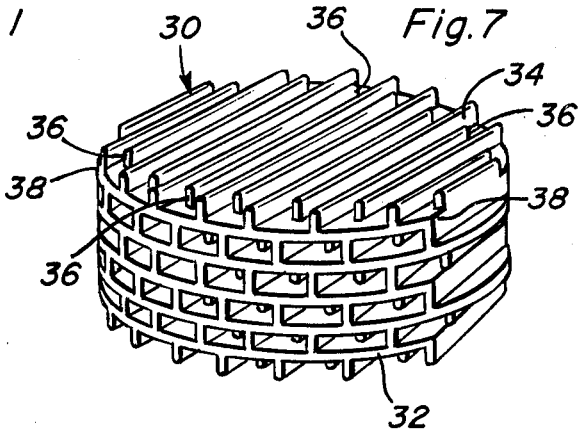
FIG. 7 is a perspective view of low dielectric inserts to be used in the water heater of the present invention.
Figure 2:
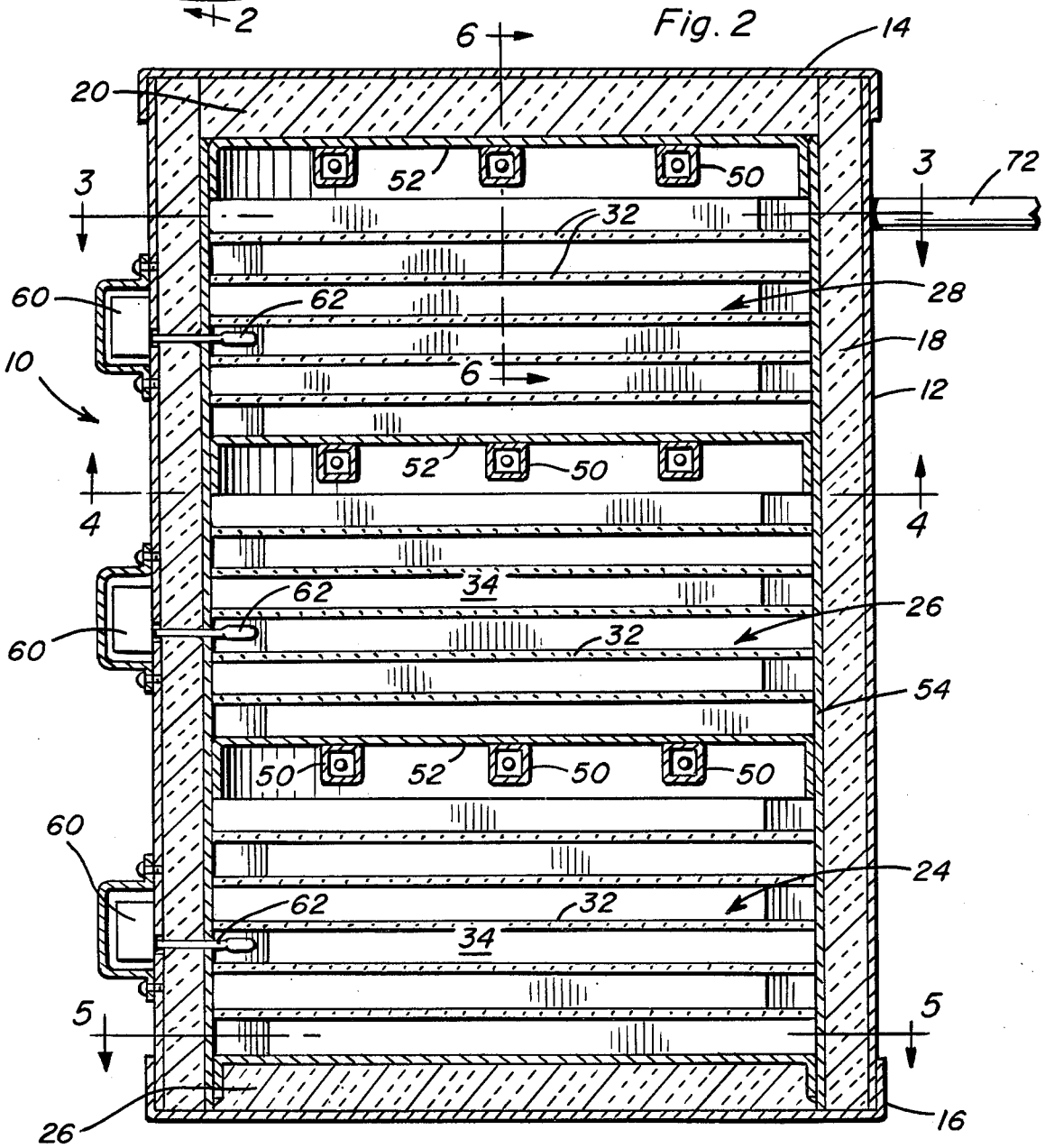
FIG. 2 is an elevational sectional view taken substantially along a plane passing through section line 2—2 of FIG. 1.
Figure 2:
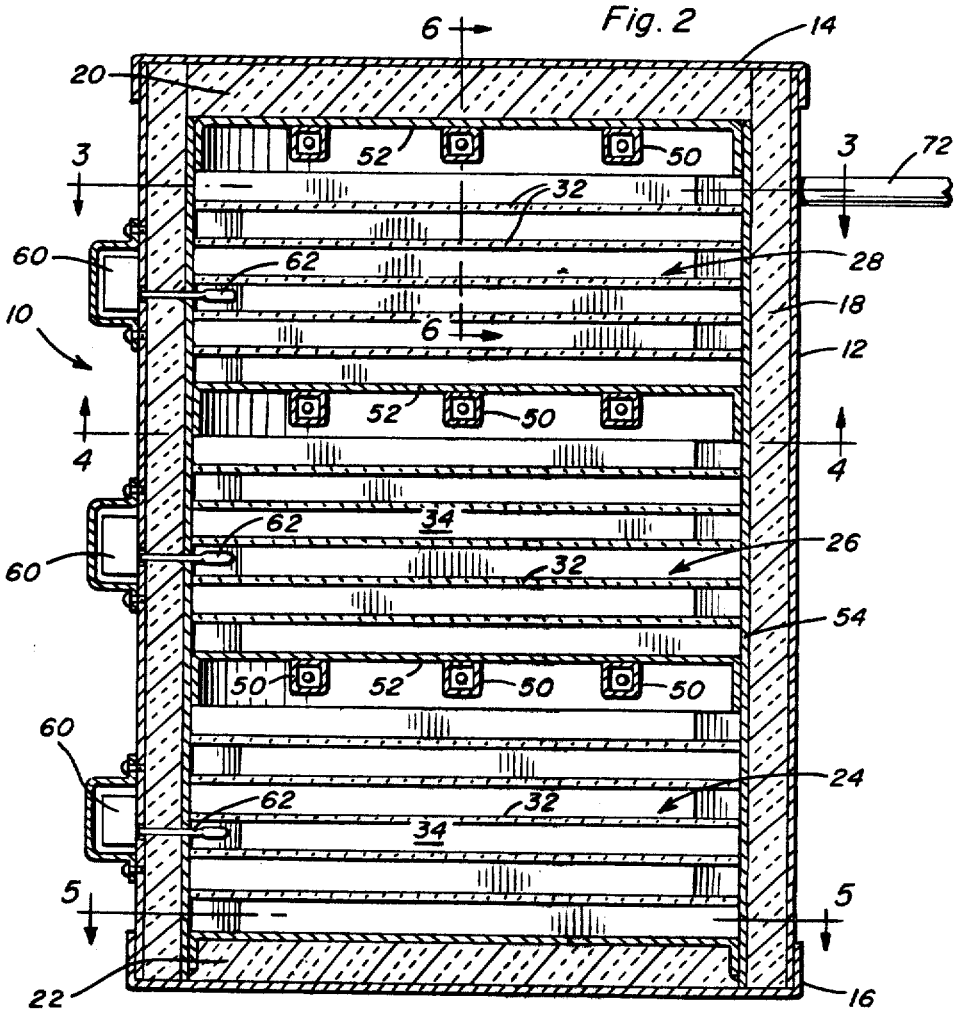

Now with reference to the drawings, a microwave water heater incorporating the principles and concepts of the present invention and generally referred to by the reference numeral 10 will be described in detail. Water heater 10 includes an outer cylindrical housing 12 which is covered by top and bottom caps 14 and 16. Disposed within housing 12 is a layer of insulation 18 which is coaxial with housing 12. Further, insulation members 20 and 22 are disposed adjacent the top and bottom caps in order to completely enclose the interior space of the water heater 10. The interior of the water heater is divided into three vertically spaced sections labelled 24, 26 and 28. Each section 24, 26 and 28 has disposed therein an insert 30 as shown in FIG. 7. Each insert includes a plurality of horizontally disposed disks 32 which are made of a low dielectric material and are attached to a plurality of elongated vertical partitions 34. Partitions 34 are also produced from a low dielectric material. The partitions 34 are placed on their associated disks in a staggered manner wherein adjacent partitions have alternate ends 36 spaced from the edge of the associated disk. In this manner, water circulating through the paths defined between adjacent partitions is forced to follow a circuitous route which extends in alternate directions transversely of the path from point of entry of the water to point of exit of the water. In order for the water to move from one level to an adjacent level, alternate cord sections of adjacent disks 32 are removed as shown at 38 in FIG. 7. Accordingly, under appropriate pressure, water can rise up from one level to the next succeeding level.

Each level of the heater includes one or more microwave energy sources 50 which are in the form of magnetron tubes. Each energy source 50 is attached to a mounting plate 52 which plates have cord sections 53 cut out of them for allowing water to pass by. The plates 52 are attached about their peripheries to an inner shell 54 which surrounds the interior of the water heater and forms a seal with each of the disks 32. A thermostat 60 having a probe 62 is disposed in each of the levels to control energization of the associated microwave energy sources. Thermostats 60 can be set at incrementally higher values for increasing the temperature of the water as it passes through the water heater. For instance, the lowest thermostat could be set at approximately 80° while the middle thermostat would be set at 115° and the highest thermostat would be set at approximately 140° or the terminal value of the desired water temperature.

An inlet line 70 extends through the side of the water heater into the lowest heating section 24. Similarly, an outlet line 72 extends from the highest heating section 28. A flow valve 80 is connected to inlet line 70 and is effective to energize all microwave energy sources 50 when water begins to flow through inlet and outlet pipe 70 and 72 thus indicating a demand for heated water. At such time, the water enters the water heater on the lowest level and circulates horizontally past the first level of vertical partitions 34. The water then rises vertically to the second level of the first heating section 24 and progresses upwardly through that section being heated through direct contact with the microwaves emitted from sources 50 and heat created in the low dielectric material forming the inserts 30. By passing the water through multiple circuitous channels, all the water should come into contact with all of the areas being heated by the microwaves. Thus, any hot spots or cool spots within the individual heating sections are nullified as the water is passed evenly through each of these. Of course, each section 24, 26 and 28 is built in a similar manner with the same horizontal and vertical circuitous paths for the water to pass through.

By providing the inlet at the bottom of the water heater 10, the efficiency of the system is increased as the water rises through the various sections of the heater, any heat loss from the water rises to the next section to aid in heating the water passing through that section. Thus, lost heat is recaptured by the vertically spaced sections.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A water heater comprising:

a housing;

a plurality of heating zones formed within said housing;

a water inlet connected to said housing;

a water outlet connected to said housing;

a plurality of energy sources, one of said energy sources being disposed in each of said heating zones;

a plurality of thermostats, one of said thermostats being disposed in each of said heating zones and connected to said energy source diposed in the associated heating zone;

a fluid flow path defined within said housing extending through each of said heating zones sequentially; and wherein said thermostats in each of said sequential zones are set at incrementally higher temperatures to increase the water temperature as it flows sequentially through said zones.

2. The water heater as defined in claim 1 wherein at least one of said energy sources is a microwave energy source.

3. The water heater as defined in claim 2 wherein said zones are vertically spaced, said inlet being connected to the lowest zone and said outlet being connected to the highest zone.

4. The water heater as defined in claim 1 wherein said fluid flow path includes a circuitous route through each of said zones, said circuitous route including a plurality of vertically spaced levels, each of said levels having a zigzag path disposed thereon.

5. The water heater as defined in claim 4 wherein said circuitous route is formed by a plurality of vertically spaced horizontal partitions and a plurality of horizontally spaced vertical partitions.

6. The system as defined in claim 1 wherein one of said inlet and outlet includes a means for sensing water flow and activating said energy sources.

7. The water heater as defined in claim 1 wherein each of said energy sources comprises a microwave energy source and further wherein said flow path is formed from a dielectric material.

* * * * *

UNITED STATES PATENT AND TRADEMARK OFFICE

CERTIFICATE OF CORRECTION

PATENT NO. : 4,284,869 Page 1 of 4

DATED : August 18, 1981

INVENTOR(S) : Leo W. Pinkstaff

It is certified that error appears in the above-identified patent and that said Letters Patent is hereby corrected as shown below:

The title page showing the illustrative figure and Figs. 2, 3, 4, 5 and 6 should be deleted to appear as per attached pages.

Signed and Sealed this

*Twenty-fifth* Day of *October 1983*

[SEAL]

*Attest:*

GERALD J. MOSSINGHOFF

*Attesting Officer* *Commissioner of Patents and Trademarks*

United States Patent [19]

Pinkstaff

[11] 4,284,869

[45] Aug. 18, 1981

[54] MICROWAVE WATER HEATER

[76] Inventor: Leo W. Pinkstaff, 1707 Talley St., Savannah, Tenn. 38372

[21] Appl. No.: 127,863

[22] Filed: Mar. 6, 1980

[51] Int. Cl.[3] ..... H05B 6/80

[52] U.S. Cl. ..... 219/10.55 A; 219/10.55 R; 219/305

[58] Field of Search ..... 219/10.55 R, 10.55 A, 219/10.55 F, 10.51, 10.65, 299, 302, 303, 304, 305, 378; 122/4 A, 13 A, 235 K; 165/139, 164; 126/344, 392

[56] References Cited

U.S. PATENT DOCUMENTS

| | | | |
|---|---|---|---|
| 1,418,011 | 5/1922 | Mehn | 219/39 |
| 2,585,970 | 2/1952 | Shaw | 219/10.55 A |
| 2,978,562 | 4/1961 | Fox | 219/10.55 A |
| 3,812,315 | 5/1974 | Martin | 219/10.55 A |
| 3,816,689 | 6/1974 | Long | 219/10.55 A |
| 3,920,945 | 11/1975 | Smith et al. | 219/10.55 R |
| 4,029,927 | 6/1977 | MacMillan | 219/10.55 R |
| 4,114,011 | 9/1978 | Stubbs | 219/10.55 A |
| 4,165,455 | 8/1979 | Mamfield | 219/10.55 A |

*Primary Examiner*—Arthur T. Grimley
*Attorney, Agent, or Firm*—Harvey B. Jacobson

[57] ABSTRACT

The water heater comprises three vertically spaced sections, each of which is controlled by a separate thermostat. Water to be heated is inputted at the lowest section and travels through a circuitous path both horizontally and vertically through that section. The thermostat is set at a low value and controls microwave tubes disposed in that section for providing initial heating of the water. The water circulates to a second section which is controlled by thermostat set at a higher temperature. Structure of the second stage is identical to that of the first and causes circuitous flow of water both horizontally and vertically through that section in order to provide intimate contact of the water with microwaves emitted by second microwave tubes. A third section is also constructed in a similar manner and includes a thermostat which is set at the final desired water temperature.

7 Claims, 7 Drawing Figures

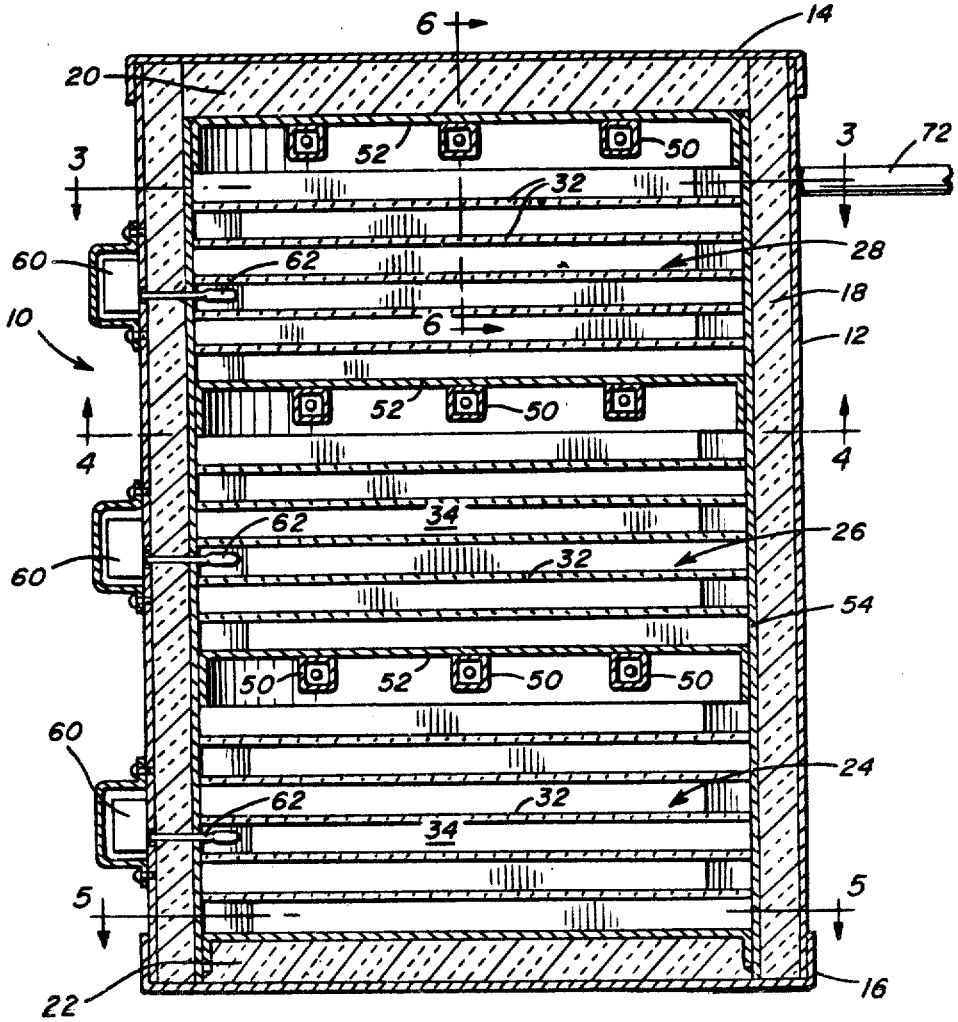

6
14
20
3
52
50
3
72
32
60
62
28
10
18
6
12
52
50
4
4
62
34
26
60
32
54
50
52
50
50
60
24
62
32
34
5
5
22
16

Fig. 3
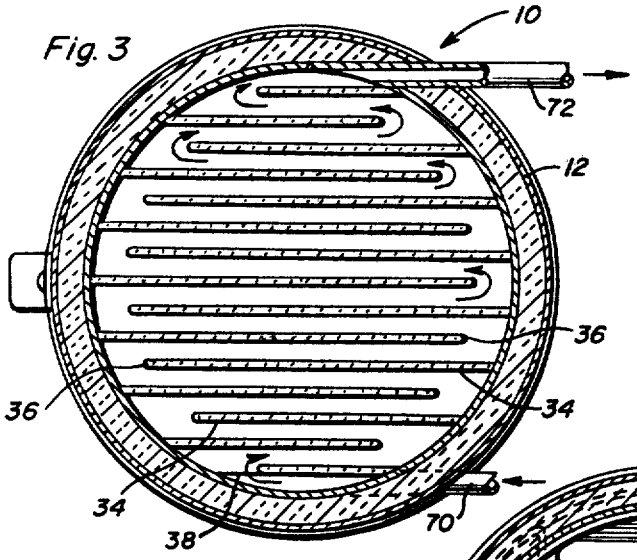
Fig. 6
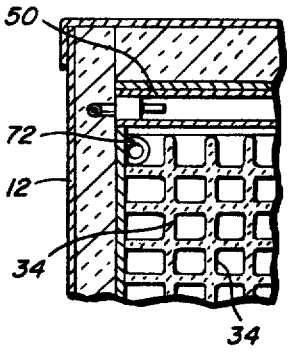
Fig. 4
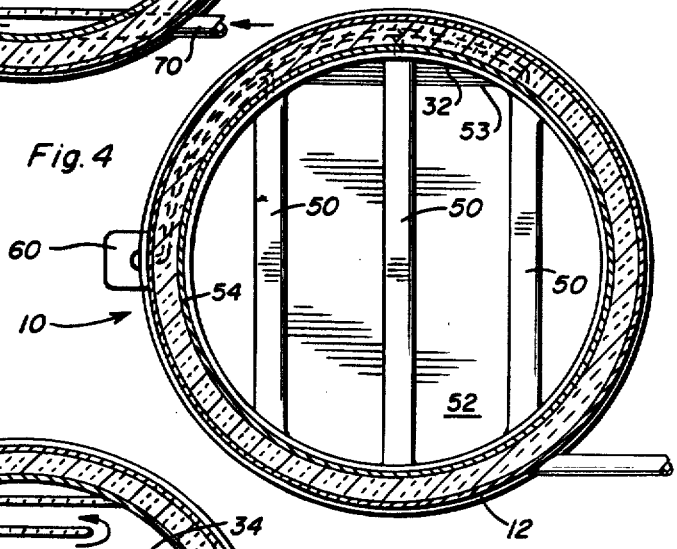
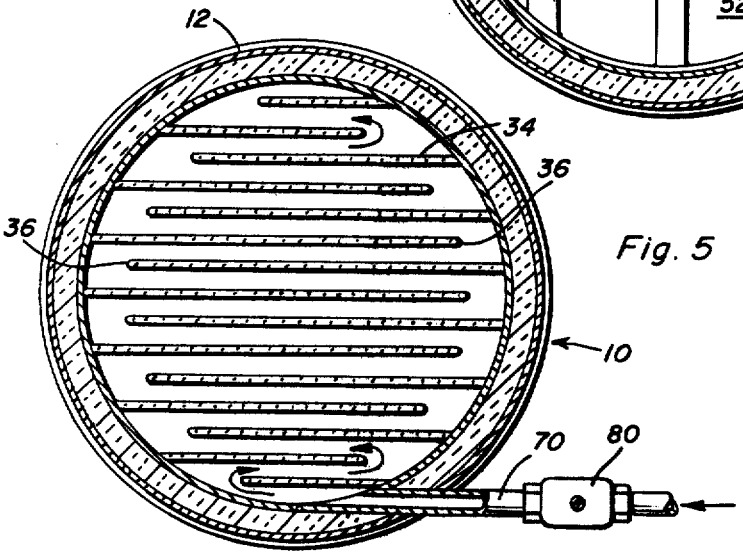
Fig. 5